US008430334B1

(12) United States Patent
Jaffe et al.

(10) Patent No.: US 8,430,334 B1
(45) Date of Patent: Apr. 30, 2013

(54) RAILROAD TIE OF NON-HOMOGENEOUS CROSS SECTION USEFUL IN ENVIRONMENTS DELETERIOUS TO TIMBER

(76) Inventors: Jonathan Jaffe, Gallatin, TN (US); Scott Powers, Rockford, MI (US)

( * ) Notice: Subject to any disclaimer, the term of this patent is extended or adjusted under 35 U.S.C. 154(b) by 273 days.

(21) Appl. No.: 13/081,271

(22) Filed: Apr. 6, 2011

Related U.S. Application Data

(63) Continuation-in-part of application No. 11/739,954, filed on Apr. 25, 2007, now Pat. No. 7,942,342.

(51) Int. Cl.
*E01B 3/10* (2006.01)
*B32B 21/00* (2006.01)

(52) U.S. Cl.
USPC ..... 238/84; 238/83

(58) Field of Classification Search ..... 238/84, 238/85, 96, 97, 98, 99, 100, 101, 102, 103; 264/171.27, 171.26, 173.12, 215; 428/420, 428/423.9, 440, 441, 451, 479.6
See application file for complete search history.

(56) References Cited

U.S. PATENT DOCUMENTS

| | | | | |
|---|---|---|---|---|
| 1,418,708 | A | | 6/1922 | Hardman |
| 1,463,979 | A | | 8/1923 | Stubbs |
| 2,157,456 | A | | 5/1939 | Koyemann |
| 2,490,548 | A | | 12/1949 | Schultz |
| 2,963,294 | A | | 12/1960 | Buck |
| 3,544,669 | A | * | 12/1970 | Schock ..... 264/171.13 |
| 3,939,617 | A | | 2/1976 | Eisses |
| 4,079,889 | A | | 3/1978 | Halpenny |
| 4,083,491 | A | | 4/1978 | Hill |
| 4,105,159 | A | | 8/1978 | Brown |
| 4,108,377 | A | | 8/1978 | Potter |
| 4,134,546 | A | | 1/1979 | Dankert |
| 4,151,145 | A | | 4/1979 | Emig et al. |
| 4,202,494 | A | | 5/1980 | Rumell |
| 4,204,660 | A | | 5/1980 | Feuillade |
| 4,236,670 | A | | 12/1980 | Limmergard et al. |
| 4,265,400 | A | | 5/1981 | Jordon |
| 4,416,419 | A | | 11/1983 | Ohno |
| 4,438,028 | A | | 3/1984 | Schmittmann et al. |
| 4,449,666 | A | | 5/1984 | Hales et al. |
| 4,634,049 | A | | 1/1987 | Steinfeld et al. |
| 4,652,495 | A | | 3/1987 | Sato et al. |
| 4,715,425 | A | | 12/1987 | Brosch |
| 4,738,878 | A | | 4/1988 | Anderson et al. |
| 5,043,225 | A | | 8/1991 | Ostby et al. |
| 5,055,350 | A | | 10/1991 | Neefe |
| 5,170,937 | A | | 12/1992 | Vanotti |
| 5,230,459 | A | | 7/1993 | Mueller et al. |
| 5,236,711 | A | | 8/1993 | Ostby et al. |

(Continued)

FOREIGN PATENT DOCUMENTS

| | | | |
|---|---|---|---|
| EP | 0440597 | A | 8/1991 |
| GB | 2 030 200 | A | 4/1980 |

(Continued)

*Primary Examiner* — Mark Le
(74) *Attorney, Agent, or Firm* — Cook Alex Ltd.

(57) ABSTRACT

The disclosure provides a railroad tie including a core, a first sleeve encapsulating the core and a second sleeve encapsulating the first sleeve. The first sleeve includes fingers running parallel to a long axis of the core along a top surface and fingers running perpendicular to a long axis of the tie along elongated sides of the first sleeve.

20 Claims, 14 Drawing Sheets

U.S. PATENT DOCUMENTS

| | | | | |
|---|---|---|---|---|
| 5,314,115 | A | 5/1994 | Moucessian | |
| 5,353,987 | A | 10/1994 | Kusakabe et al. | |
| 5,540,382 | A | 7/1996 | Scheller | |
| 5,609,295 | A | 3/1997 | Richards | |
| 5,713,517 | A | 2/1998 | Loison | |
| 5,713,518 | A | 2/1998 | Fox et al. | |
| 5,722,589 | A | 3/1998 | Richards | |
| 5,799,870 | A | 9/1998 | Bayer | |
| 5,826,791 | A | 10/1998 | Broughton | |
| 5,886,078 | A | 3/1999 | Sullivan et al. | |
| 5,916,932 | A | 6/1999 | Nosker et al. | |
| 6,021,958 | A | 2/2000 | Smith | |
| 6,059,199 | A | 5/2000 | Eriksson et al. | |
| 6,070,806 | A | 6/2000 | Barbakadze et al. | |
| 6,191,228 | B1 | 2/2001 | Nosker et al. | |
| 6,237,856 | B1 | 5/2001 | Bachmann et al. | |
| 6,247,651 | B1 | 6/2001 | Marinelli | |
| 6,451,444 | B1 * | 9/2002 | Ollila et al. | 428/479.6 |
| 6,503,193 | B1 | 1/2003 | Iwasaki et al. | |
| 6,708,896 | B2 | 3/2004 | Robinson | |
| 6,749,103 | B1 | 6/2004 | Ivanov et al. | |
| 6,766,963 | B2 | 7/2004 | Hansen | |
| 6,828,372 | B2 | 12/2004 | Sullivan et al. | |
| 6,911,171 | B2 * | 6/2005 | Lauer | 264/248 |
| 7,011,253 | B2 | 3/2006 | Nosker et al. | |
| 7,138,437 | B2 | 11/2006 | Giorgini et al. | |
| 7,147,169 | B2 | 12/2006 | Walsh | |
| 7,156,319 | B2 | 1/2007 | Kowalski | |
| 7,220,458 | B2 | 5/2007 | Hollis et al. | |
| 7,452,609 | B2 * | 11/2008 | Hayashida et al. | 428/451 |
| 7,942,342 | B2 * | 5/2011 | Powers et al. | 238/84 |
| 2002/0062545 | A1 | 5/2002 | Niedermair | |
| 2005/0106406 | A1 | 5/2005 | Curtis et al. | |
| 2006/0246265 | A1 | 11/2006 | Rogers et al. | |
| 2007/0187522 | A1 | 8/2007 | Kirchmer et al. | |
| 2008/0032046 | A1 * | 2/2008 | Sporn et al. | 427/299 |
| 2008/0179418 | A1 | 7/2008 | Brough et al. | |
| 2010/0084787 | A1 | 4/2010 | Brough et al. | |

FOREIGN PATENT DOCUMENTS

| | | | |
|---|---|---|---|
| GB | 2 087 320 | A | 5/1982 |
| WO | WO 97/20108 | | 6/1997 |
| WO | WO 2007/009362 | A1 | 1/2007 |

* cited by examiner

RAILROAD TIE OF NON-HOMOGENEOUS CROSS SECTION USEFUL IN ENVIRONMENTS DELETERIOUS TO TIMBER

CROSS-REFERENCE TO RELATED APPLICATION

This application is a continuation-in-part of and claims the benefit of co-pending U.S. patent application Ser. No. 11/739,954 which was filed Apr. 25, 2007, the disclosure of which is hereby incorporated by reference in its entirety.

BACKGROUND OF THE INVENTION

The purpose of a railroad tie is to connect the earth, or other intermediate supporting base, to plates which connect to rails. They also provide for the proper spacing (gauge or gage) between rails. In turn the rails support locomotives, passenger, freight or service cars as they transit or park.

FIG. 1 shows the cross section of a treated timber tie 10 in a common cross section of seven inches (7") tall and nine inches (9") wide. Common lengths for cross ties are eight feet (8'), eight foot and six inches (8'-6") and nine feet (9'). Switch ties are longer. In this drawing the pressured applied preservative 20 does not penetrate through the entire tie. There is a core 30 that may remain untreated.

Railroad ties are traditionally made of wood, though some are of concrete or all-plastic or plastic-composite. There are several standard sizes, one common size being seven inches tall by nine inches wide by nine feet long. Other standards include cross sections of 6"×", 6"×9" and lengths of 8'-0" and 8'-6".

Ties must be strong enough to maintain support and gauge under lateral loads, static vertical loads, and dynamic vertical loads. The tie must be resistant to the dynamic load which can cause the tie plate to move and abrade the tie. The tie must be able to function despite environmental stresses of thermal expansion, ultraviolet (UV) radiation, attack from microorganisms, fungi, insects and other life forms. It is highly preferable that ties be installable using the existing base of standardized installation equipment and fasteners. Some rail systems use a "third rail" to conduct power to trains. For this and other reasons, railroad ties should not be conductors of electricity.

The predominant tie in service is a hardwood timber treated with creosote, coal tar, chromated copper arsenate or other preservative. Over time these preservatives leach from the tie to the surrounding earth and eventually migrate to the surrounding areas, including water tables. There are few safe methods for disposing of treated timber ties. Stacking them in landfills does little to retard leaching. Open air burning releases the toxins into the atmosphere. Closed effluent burning with contaminant capture is expensive.

Because concrete and reinforced concrete ties are highly inflexible they do not allow a flex-and-resume support of the rails. More concrete ties are required per mile of track which increases the cost per mile. The cost per tie is also higher. Further, the increased weight of concrete requires changes to installation equipment and procedures.

Both timber and concrete ties can accept water into cracks or grain separations. As water freezes it expands and can force the cracks wider, leading to a reduction in tie strength. For reinforced concrete ties this crack expansion can also expose the metallic reinforcing material to air, thereby initiating the deleterious effects of rust, further reducing tie strength.

More than ten million ties were installed as new or replacements during each of 1996-2010. With thousands of ties per mile, the introduction of a functionally equivalent or superior, longer lived, and lower life cycle cost tie is materially beneficial to rail operators, maintains or improves rail system safety, and is ecologically beneficial.

Thus, there is a need for a tie with a combination of lower manufacturing times, better spike retention, increased resistance to abrasion, lighter weight, and lower cost than existing concrete, plastic or composite ties.

There is a further need for processes for manufacturing a tie having the above characteristics in an efficient and environmentally sensitive manner.

SUMMARY OF THE INVENTION

A railroad tie according to embodiments of the present invention uses a wood, composite wood, wood-plastic or engineered plastic core and is encapsulated in one to many layers of plastic, or plastic-composite materials. A complete encapsulation also is referred to as a sleeve or a jacket. Only the outer-most encapsulating layer is exposed to the elements. A single plastic layer is, or multiple layers are, applied in a high pressure mold to promote adhesion between the core and adjacent plastic layer as well as between layers to increase strength. High pressure also helps the plastic or plastic-composite material to displace voids in the core with the result being a stronger and longer lasting product than natural wood could provide.

The core may be an old tie removed from service, but is still adequately strong. It may be trimmed to size and encapsulated. The encapsulation retards leaching of preservatives in the core.

Alternatively, the core may start as an unusable treated timber tie rendered into fibers. Rotten, or otherwise undesirable, fibers are separated from reusable fibers and disposed of. The reusable fibers may be mixed with a binder and formed into cores of the appropriate size. Again, the encapsulation retards leaching of any fiber-borne preservative to the environment.

The core may be an engineered wood, structured wood, wood by-product, plastic/wood beam or plastic composite.

The encapsulation may be an engineered plastic or plastic-composite section.

The top side of the outermost encapsulation may be textured or pigmented to reduce glare or provide another aesthetically pleasing or functional appearance. The underside may be patterned to increase friction with ballast or other bed material, so as to retard lateral movement. The encapsulation(s) may be colored for an aesthetic or functional purpose. Other functional or decorative moldings may be added. These include, but are not limited to, owner identification, date of manufacturing, location of manufacturing facility, mold number, lot number, etc.

In a first aspect, the present disclosure provides a railroad tie that includes a core having a wood, wood-product, engineered wood product, or engineered plastic product, a first sleeve encapsulating the core, wherein the first sleeve includes at least one of the group consisting of plastic, plastic-composite, or non-plastic polymers, and a second sleeve encapsulating the first sleeve, wherein the second sleeve includes at least one of the group consisting of plastic, plastic-composite, or non-plastic polymers. The core has a longitudinal axis running parallel to its longest dimension, wherein the first sleeve includes a top surface having top fingers protruding therefrom and gaps between the top fingers that run parallel to the longitudinal axis of the core, and having side surfaces with each side surface including side fingers protruding from the respective side surface and having gaps between the side fingers that run perpendicular to the longitudinal axis of the core. The second sleeve includes respective top fingers that fill the gaps between the top fingers of the first sleeve and that run parallel to the longitudinal axis of the core, and respective side fingers that fill the gaps between the side fingers of the first sleeve and that run perpendicular to the longitudinal axis of the core.

In another aspect, the present disclosure provides a method of manufacturing a railroad tie that includes obtaining a core that has a wood, wood-product, engineered wood product, or engineered plastic product within a mold, the core having a longitudinal axis running parallel to its longest dimension. The method also including melting a first sleeve material that includes a plastic, plastic-composite, or non-plastic polymers and injecting the first sleeve material into the mold containing the core so that the first sleeve material forms a first encapsulation of the core, wherein the first encapsulation includes a solid layer with a plurality of top fingers protruding from the solid layer along a top surface and forming gaps between the plurality of top fingers that run parallel to the longitudinal axis of the core, and with a plurality of side fingers protruding from the solid layer along side surfaces and forming gaps between the plurality of side fingers that run perpendicular to the longitudinal axis of the core. The method includes cooling the first encapsulation and core. The method also includes melting a second sleeve material that has a plastic, plastic-composite, or non-plastic polymers and injecting the second sleeve material into a mold containing the core that has been encapsulated in the first encapsulation, so that the second sleeve material flows between the fingers formed in the first encapsulation by the first sleeve material, thereby forming fingers in the second sleeve material that run parallel to the longitudinal axis of the core along the top surface of the first sleeve and that run perpendicular to the longitudinal axis of the core along the side surfaces of the first sleeve, so that the second sleeve material forms a second encapsulation that encapsulates the first encapsulation. Also included in the method of manufacturing is cooling the second and first encapsulations and the core

BRIEF DESCRIPTION OF DRAWINGS

Aspects, features, benefits and advantages of the embodiments of the present invention will be apparent with regard to the following description, appended claims and accompanying drawings where:

DETAILED DESCRIPTION OF THE INVENTION

Figure 1:
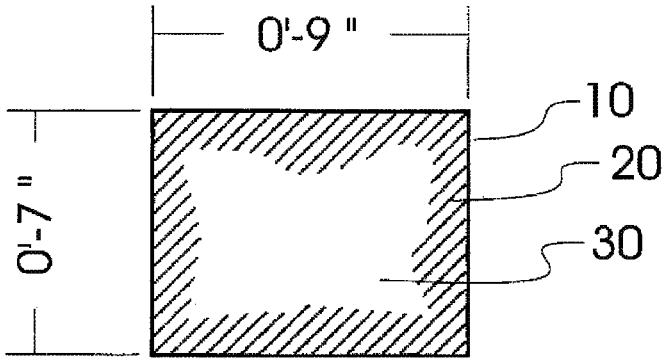
FIG. 1 illustrates a cross section of a traditional timber tie showing irregular penetration of preservative.
Figure 2:
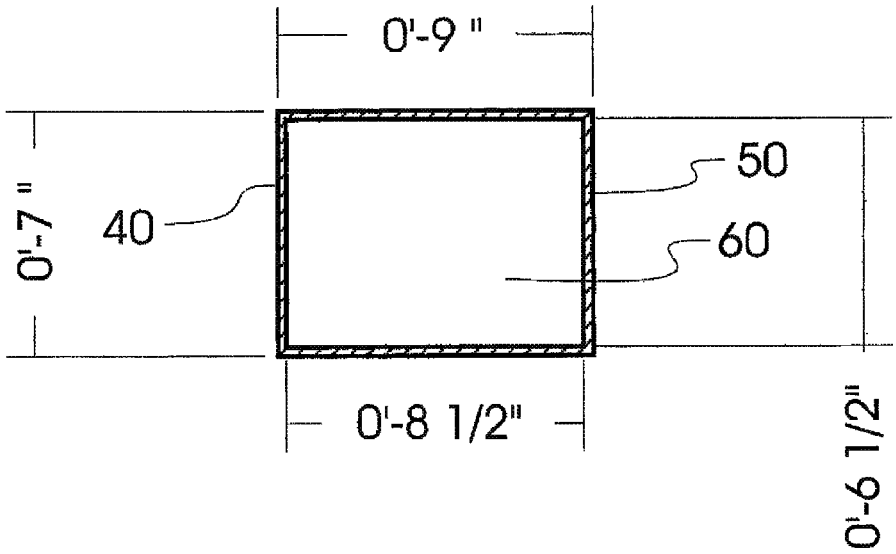
FIG. 2 illustrates a cross section of an embodiment showing a single layer encapsulation.

FIG. 2 shows a railroad tie 40 according to an embodiment of the present invention. Railroad tie 40 has a cross section of 7"×9" with a core 60 of cross section 6.5"×8.5" encapsulated in a single sleeve 50 0.25" inches thick.

Figure 3:
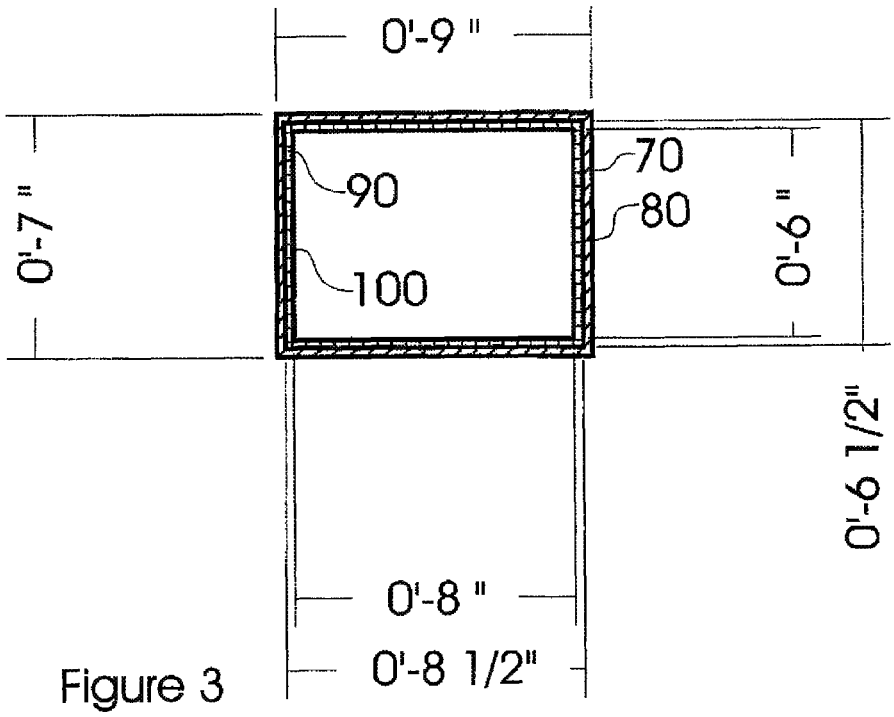
FIG. 3 illustrates a cross section of an embodiment showing a double layer encapsulation.

FIG. 3 shows a railroad tie 70 according to another embodiment of the present invention. Railroad tie 70 has a common cross section of 7"×9" with a 6"×8" core 100, an inner sleeve 90, 0.25" in thickness, and an outer sleeve 80, 0.25" in thickness. Railroad tie 70, encapsulated in two sleeves, holds several advantages over the railroad tie 40, having only a single layer of encapsulation. First, plastic cools at a non-linear rate. During the manufacturing process, a 0.25" layer may cool sufficiently after only thirty seconds. A 0.5" layer will take more than sixty seconds to cool. Thus, using two layers may result in a lower manufacturing time, given the same desired final thickness. Second, using multiple sleeves allows different materials to be used for each sleeve. Third, using multiple sleeves allow the interface between the sleeves to be molded in an interlocking form, resulting in increased strength. However, it is to be understood that single, dual, or even greater levels of encapsulation are within the scope of this invention.

The cores 60 and 100 may be new treated timber ties reduced to the 6.5"×8.5" and 6"×8", respectively. Because the cores 60 and 100 are encapsulated by the sleeve 50 and sleeves 80 and 90, respectively, the preservative in the cores 60 and 100 is retarded from leaching into the surrounding environment. Further, the cores 60 and 100 are protected from the elements. Alternatively, the cores 60 and 100 may be used treated timber ties that are structurally sound, but worn towards the outer edges. The outer edges are removed in sufficient quantity to result in the cores 60 and 100 shown in FIGS. 2 and 3, respectively.

The cores 60 and 100 may alternatively be constructed from used timber ties that are no longer structurally sound, but contain sound fibers and strands.

The sleeves 50, 80 and 90 may be constructed from any number of non-plastic polymers, plastics or plastic-composites. Preferably, inner sleeve 80 is constructed from a polyester, such as poly ethylene terephthalate, or PET. The PET may be additionally be mixed with a fine rubber, such as a rubber dust, and a stabilizer. Rubber dust performs two functions. First, one of the elements in rubber dust is carbon black, which assists in adding UV resistance to the sleeves. Second, the rubber dust consumes volume and is cheaper than plastic, i.e., a filler. The stabilizer may be, for instance, FUSABOND co-polymer, manufactured by DuPont. The stabilizer may improve the compatibility between the base plastic, such as PET, and any additives, fillers, or reinforcing agents, such as the rubber dust. Sleeves 50 and 90 are preferably constructed from a polyolefin such as high density poly ethylene, or HDPE. The HDPE may be mixed with a fine rubber dust and a stabilizer, as discussed above with respect to PET. As sleeves 50 and 90 are externally visible, a colorant may be added to the HDPE to attain the desired color. Additional additives, such as scents, may be added to the HDPE. Inner sleeve 80 and outer sleeve 90 are preferably greater than 75%, by weight, of PET and HDPE, respectively.

Although not shown in FIGS. 2 and 3, the end surfaces of railroad ties 40 and 70 are also covered by the sleeves 50, and 80 and 90, respectively. The end surfaces may be unadorned, or they may be impressed with information, such as the identity of the manufacturer.

The side surfaces of railroad ties 40 and 70 are preferably smooth to reduce friction during material handing or patterned to increase friction when set in ballast.

The upper surface of railroad ties 40 and 70 may be patterned in either a decorative or functional pattern. Such functional patterns include, but are not limited to, those patterns resulting in increased friction or glare reduction.

The bottom surface of the railroad ties 40 and 70 is preferably patterned depending on the surface upon which the railroad ties 40 and 70 are intended to be placed. For instance, the railroad ties 40 and 70 may be placed in ballast, requiring one type of patterning, or on a smooth surface such as those found in smooth floored tunnels, requiring different patterning.

Figure 4A:
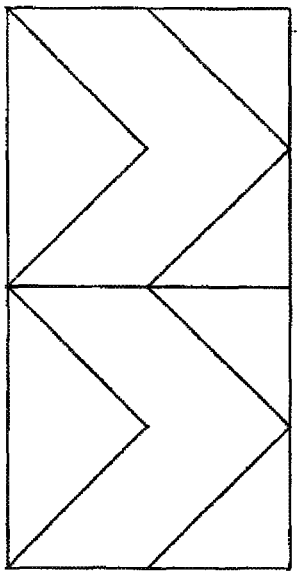
FIGS. 4A-4C illustrate pattern elements for a tie in ballast.
Figure 4B:
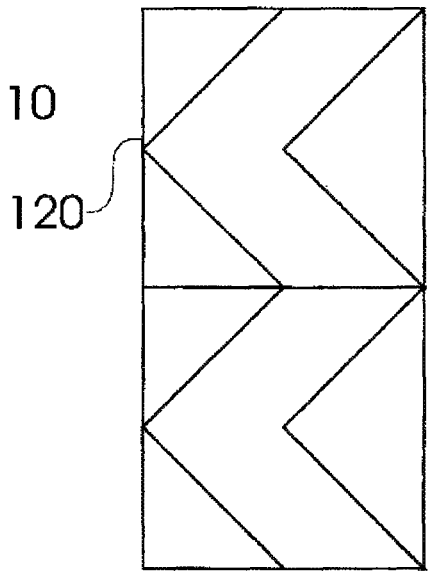
Figure 4C:
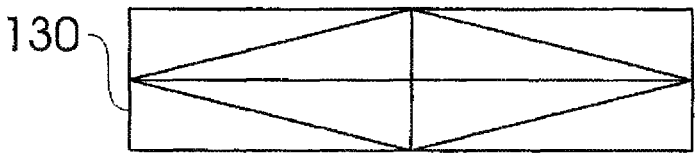

For ties that are to be placed on ballast, the tread patterns should capture the ballast material (e.g., gravel rock) to increase friction. In FIGS. 4A-4C and FIGS. 5-7, the lines indicate ridges that protrude from the surrounding surface. The ridges need not be squared, but may instead be chamfered with a draft angle. FIGS. 4A, 4B and 4C each show an embodiment of a tread pattern section. FIG. 4A is a right pointing chevron section 110, and shows two parallel chevrons each of which is bounded by three triangles. In this embodiment, the chevron section contains all 90-45-45 degree triangles, though one of ordinary skill would understand that the angles may be modified while still staying within the scope of the present invention. The chevrons are 90-degrees at the apex and 135-degrees at the sides. In this embodiment, the end result is a two square pattern. The left pointing chevron 120, shown in FIG. 4B, is a minor image of the right pointing 110 chevron. FIG. 4C shows another section 130 composed of eight triangles (8 T) where the triangles are at angles other than 90-degrees or 45-degrees. The mix of differing angles increases the probability of a rock capture and increased friction. The three patterns illustrated in FIGS. 4A, 4B and 4C may be combined in many ways to achieve a bottom surface with higher friction in ballast than a smooth bottom surface.

Figure 5:
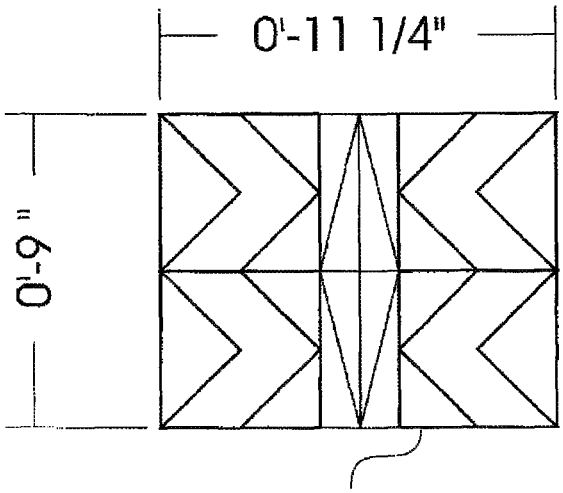
FIG. 5 illustrates the bottom of an embodiment showing pattern elements in a first pattern.
Figure 6:
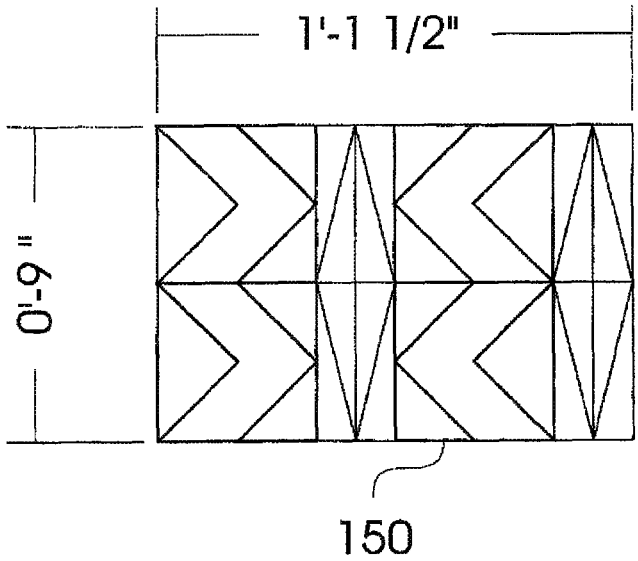
FIG. 6 illustrates the bottom of an embodiment showing pattern elements in a second pattern.
Figure 7:
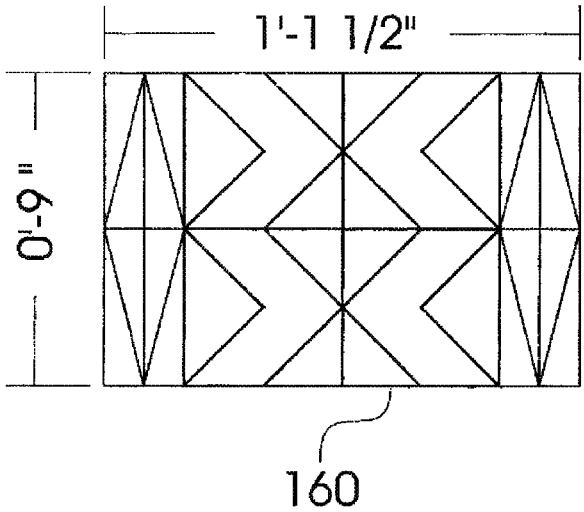
FIG. 7 illustrates the bottom of an embodiment showing pattern elements in a third pattern.

FIGS. 5, 6 and 7 show various combinations of the sections shown in FIGS. 4A, 4B and 4C. FIG. 5 shows a combination 140 comprising one 8 T section 130 placed between left pointing 120 and right pointing 110 chevron patterns. FIG. 6 shows a combination 150 comprising one 8 T section 130 placed between alternating left pointing 120 and right pointing 110 chevron patterns. FIG. 7 shows a combination 160 one 8 T section 130 placed before and after each pair of left pointing 120 and right pointing 110 chevron patterns. The combinations 140, 150 and 160 may be repeated over the length of the bottom surface of the tie.

The bearing surfaces of ties according to an embodiment of the present invention having a patterned bottom surface may range in width from near-zero for a knife edge to two inches (2") wide. The molding draft angle of the raised tread to the relieved section may range between 0.01-degrees (near vertical) to 89.99-degrees (near flat).

Figure 8:
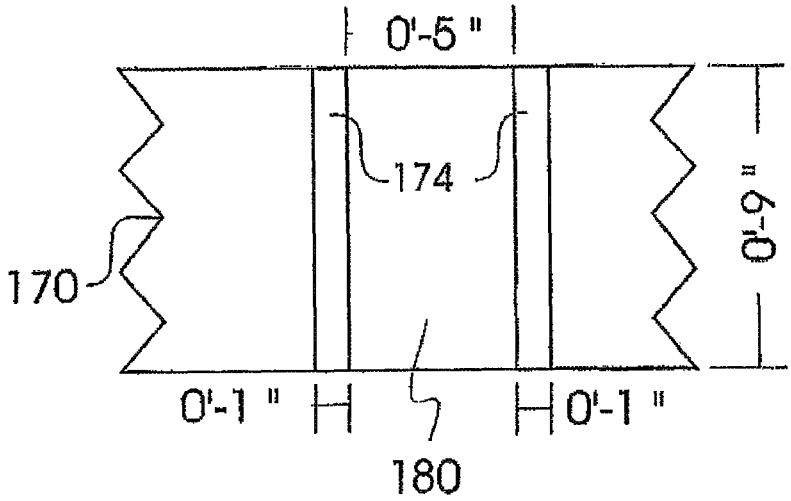
FIG. 8 illustrates a bottom view of an embodiment showing a pattern element suitable for a tunnel.
Figure 9:
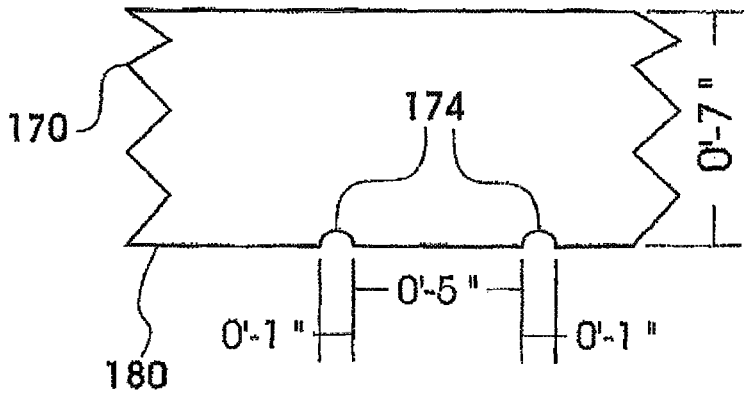
FIG. 9 illustrates a side view of an embodiment showing a pattern element suitable for a tunnel.

Not all ties are placed in ballast. To improve performance in tunnels, or other smooth bottomed surfaces, FIG. 8 shows a bottom surface 180 of a tie section 170 showing one inch (1") diameter channels 174 at five inch (5") intervals. These channels are over the length of the tie. FIG. 9 shows a side surface of the tie section showing the same spacing and channels 174 along the bottom surface 180. Although the 5" spacing and 1" diameter are shown here, other combinations of spacing, diameter, and shape are possible. The channels allow for drainage.

Hereinafter, a preferred method of manufacturing the tie shown in FIG. 3 will be described. As shown in FIG. 3, the completed tie 70 according to an embodiment of the present invention comprises three elements, the core 100, inner sleeve 90 and outer sleeve 80. To construct the core 100, a whole railroad tie in a 7"×9"×8'–6" size is first obtained. The whole railroad tie is then cut to the desired length, and then cut in half longitudinally to make two cores 100, nominally 4.5" tall and 7" wide. One core 100 is set aside for later use. For the inner sleeve 90, PET regrind is first obtained. Regrind refers to plastic feed stock that has been sorted, ground, cleaned, and otherwise processed to be ready to be used immediately. The PET regrind is then preferably mixed with a fine virgin rubber dust. A stabilizer is also preferably added to the PET regrind. The PET, rubber dust and stabilizer are placed in a blender and blended. The PET mixture is then transferred to an injection molding machine. For the outer sleeve 80, HDPE regrind is first obtained. The HDPE regrind is then preferably mixed with a fine rubber dust, either de-vulcanized, recycled rubber or virgin rubber. A stabilizer is also preferably added to the HDPE regrind. The HDPE, rubber dust and stabilizer are placed in a blender and blended. The HDPE mixture is then transferred to an injection molding machine.

A mold is formed in the desired shape of the final product. If two layers of sleeves are desired, two molds may be necessary. Alternatively, molds are available that may reconfigure themselves, allowing both layers to be formed in a single mold. The core 100 may be suspended in the mold in various ways, such as by a rod. The hole in the sleeves resulting therefrom may be filled in at a later time.

The 4.5"×7" core 100 is placed in the mold. Then, the PET injection molding machine supplies the PET mixture into the mold to form the inner sleeve 90. After the inner sleeve 90 is formed, the HDPE injection molding machine supplies the HDPE mixture in the mold to form the outer sleeve 80. Alternatively, if a single mold is used for both layers, PET is first injected, then allowed to cool. Then, the mold may be reconfigured, and the HDPE may be injected into the mold.

Figure 10:
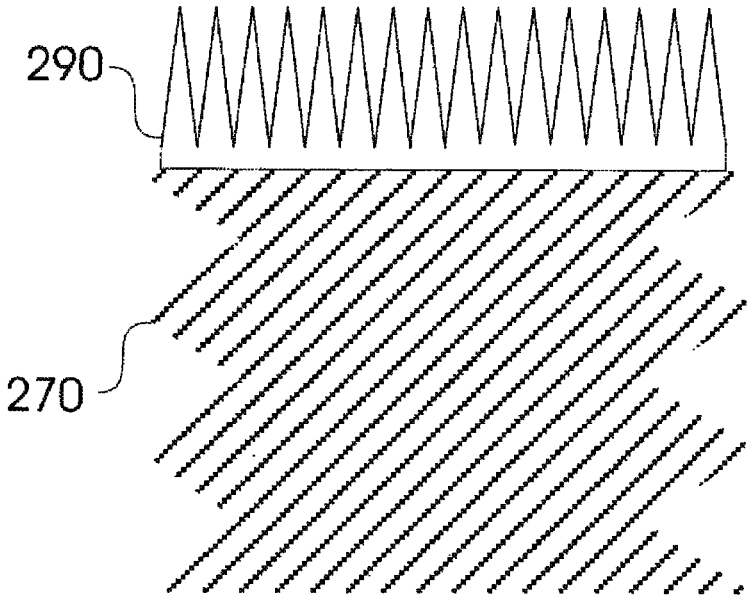
FIG. 10 illustrates a cross sectional view of the core and inner sleeve during manufacture of an embodiment.
Figure 11:
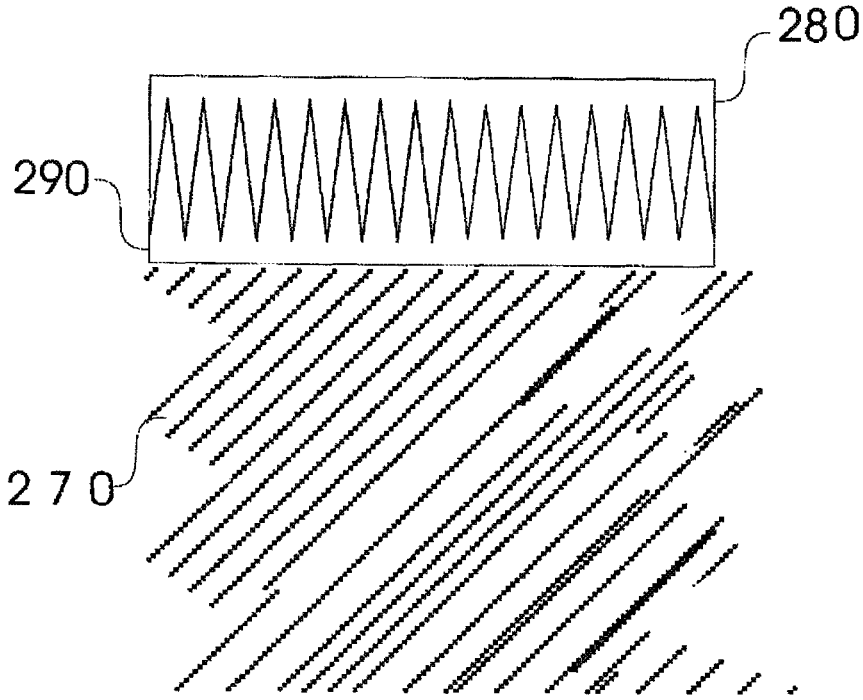
FIG. 11 illustrates a cross sectional view of the core, inner sleeve, and outer sleeve according to an embodiment.

In a preferred embodiment and referring to FIG. 10, the inner sleeve 290 is molded so as to have a solid base layer in contact with the core 270, with fingers protruding therefrom. These fingers give inner sleeve 290 a ridged surface. FIG. 11 shows a cross-section of a portion of a completed tie. It shows inner sleeve 290, including fingers, as well as the outer sleeve 280 having opposite, interlocking fingers, and a solid layer. In a preferred embodiment, the sides and top of the tie comprise an inner sleeve 290 having a 0.25" thick solid layer and 0.5" fingers, as well as an outer sleeve 280 having 0.5" fingers and a 0.25" solid layer, resulting in a total thickness of 1.0" because the fingers interlock. Given a 7" wide core 270, this results in the desired final width of 9". The bottom of the tie is preferably formed in a similar fashion, only differing in that the outer sleeve 280 additionally includes 0.5" of high friction ridges. By forming the first and second sleeves in the above fashion, the sleeves may be formed and cooled quicker than if, for instance, each of the two sleeves were a 0.5" solid layer. This is because two sleeves, each having a 0.25" solid layer with 0.5" interlocking fingers, will cool quicker than two sleeves, each a 0.5" solid layer, even though both result in a total encapsulation of 1.0".

In an alternate embodiment, rather than obtaining PET and HDPE regrind, PET and HDPE recyclate may instead be obtained. Recyclate refers to plastic feed stock that has been sorted by type but requires further processing to remove contaminants, such as labels and traces of previous contents, and grinding before being ready for use. Before being introduced to the respective mixers and if the PET or HDPE recyclate is obtained in baled form, the PET or HDPE bales are placed in a debaler, wherein the bales of PET or HDPE recylate are broken apart into a more manageable stream of recyclate. PET or HDPE recyclate from the debaler is then forwarded to a shredder, wherein the large pieces of PET or HDPE recylate are reduced into smaller shreds of plastic. The shreds of PET or HDPE are then forwarded to a separator, which separates the PET or HDPE from non-plastic elements such as labels. The non-plastic elements may be removed to a closed effluent furnace where they can be consumed as fuel to generate some electricity. The separated shreds of PET or HDPE may be used identically to the PET or HDPE regrind above.

In another embodiment, old and scrap ties may be recycled to obtain new cores 100. First, remaining metal, such as plates and spikes, are removed from the old and/or scrap ties. The ties are then rendered into fibers and strands which are sorted. Rotten, overly short, or otherwise undesirable fibers may be disposed of by sending them to a closed effluent furnace to be consumed to generate electricity. The remaining fibers may then be mixed with a binder such as, for instance, an isocyanate resin, heated and pressed to form a large sheet or billet. The large sheet or billet may then be processed to create ready-to-use cores of a desired size, which may be used identically to the 4.5"×7" cores 100 in the process described above. The core 100 produced by this method is greater than 80% wood fibers, by weight.

In another embodiment, scrap tires may be recycled to obtain rubber dust. Scrap tires may first be subject to a gross shred which turns the tires into crumbs. At this stage, the tire crumbs still contain metal fibers, such as remnants of steel belting and valves, and the rubber in the tire crumbs is vulcanized. Tire crumbs may be used as fuel in a closed effluent furnace. Alternatively, the tire crumbs may be finely shredded and crushed to de-vulcanize the rubber. The resulting finely shredded rubber dust may be used instead of the virgin rubber dust in the process described above. The shredding process also separates the metal from the shredded rubber dust. The metal may then be sold to a recycler.

Turning to FIGS. 12-15, additional perspective views and exploded perspective views of portions of another embodiment of a railroad tie are shown. For instance, it will be appreciated that this example embodiment of a railroad tie 310 includes a core 330, an inner or first sleeve 340 and an outer or second sleeve 370. Each of the first and second sleeves provides a full encapsulation. Thus, the first sleeve 340 also may be referred to as a first encapsulation, because it is formed completely around the core 330. In turn, the second sleeve 370 also may be referred to as a second encapsulation, because it is formed completely around the first encapsulation. It will be appreciated that more than two encapsulations could be used, and that the core 330, and therefore, the tie 310 has a longitudinal axis A that runs parallel to its longest dimension.

Figure 12:
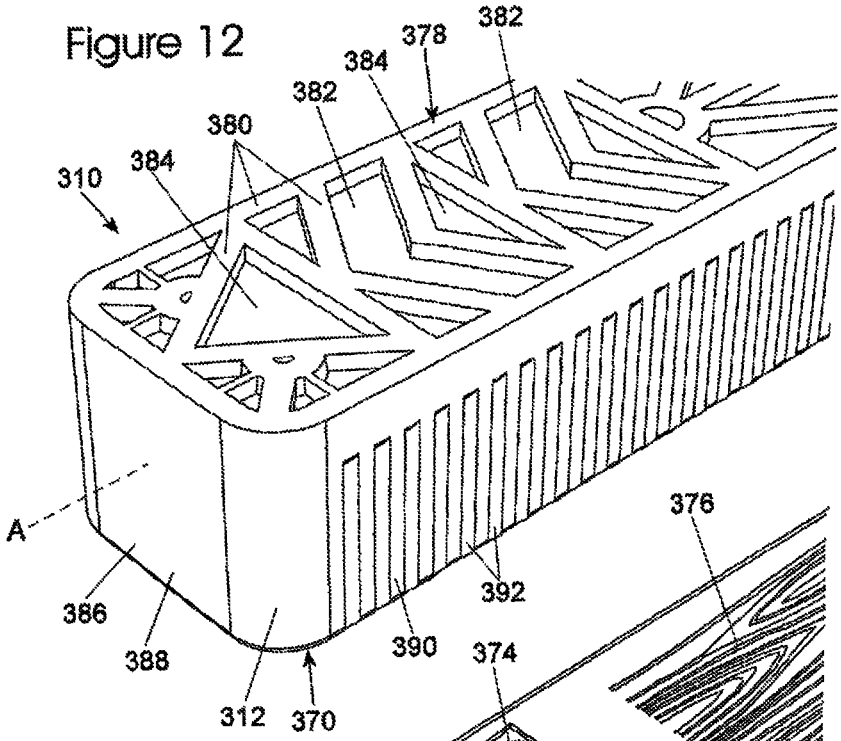
FIG. 12 illustrates a bottom perspective view of a portion of a further embodiment.
Figure 13:
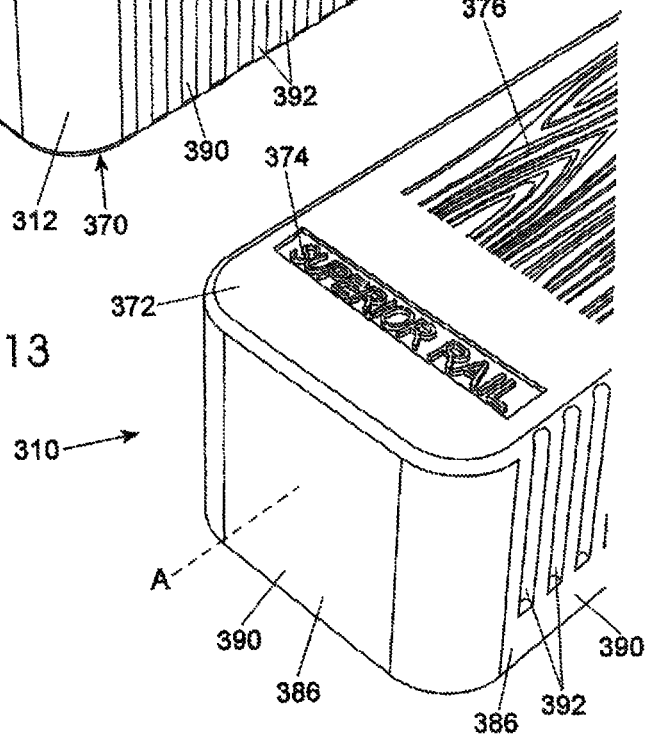
FIG. 13 illustrates a top perspective view of a portion of the embodiment of FIG. 12.
Figure 14:
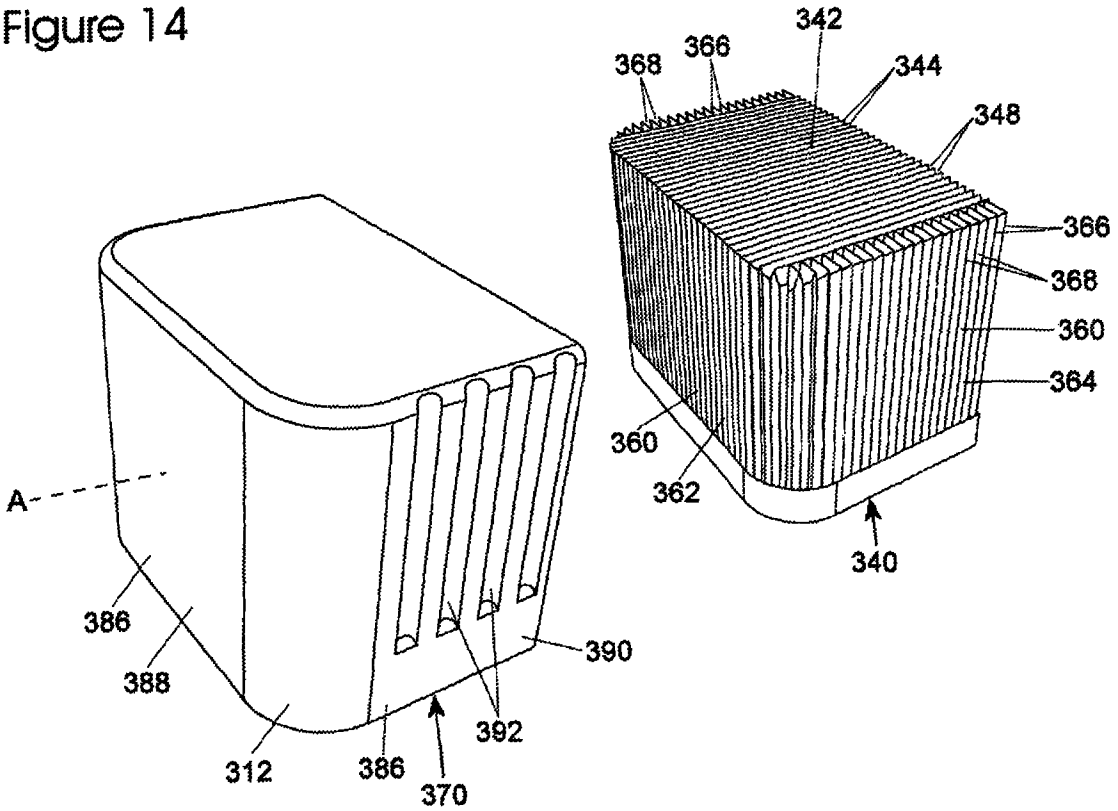
FIG. 14 illustrates a top exploded perspective view of an end portion of the inner and outer encapsulations of a simplified version of the embodiment of FIG. 12.
Figures 15, 15A:
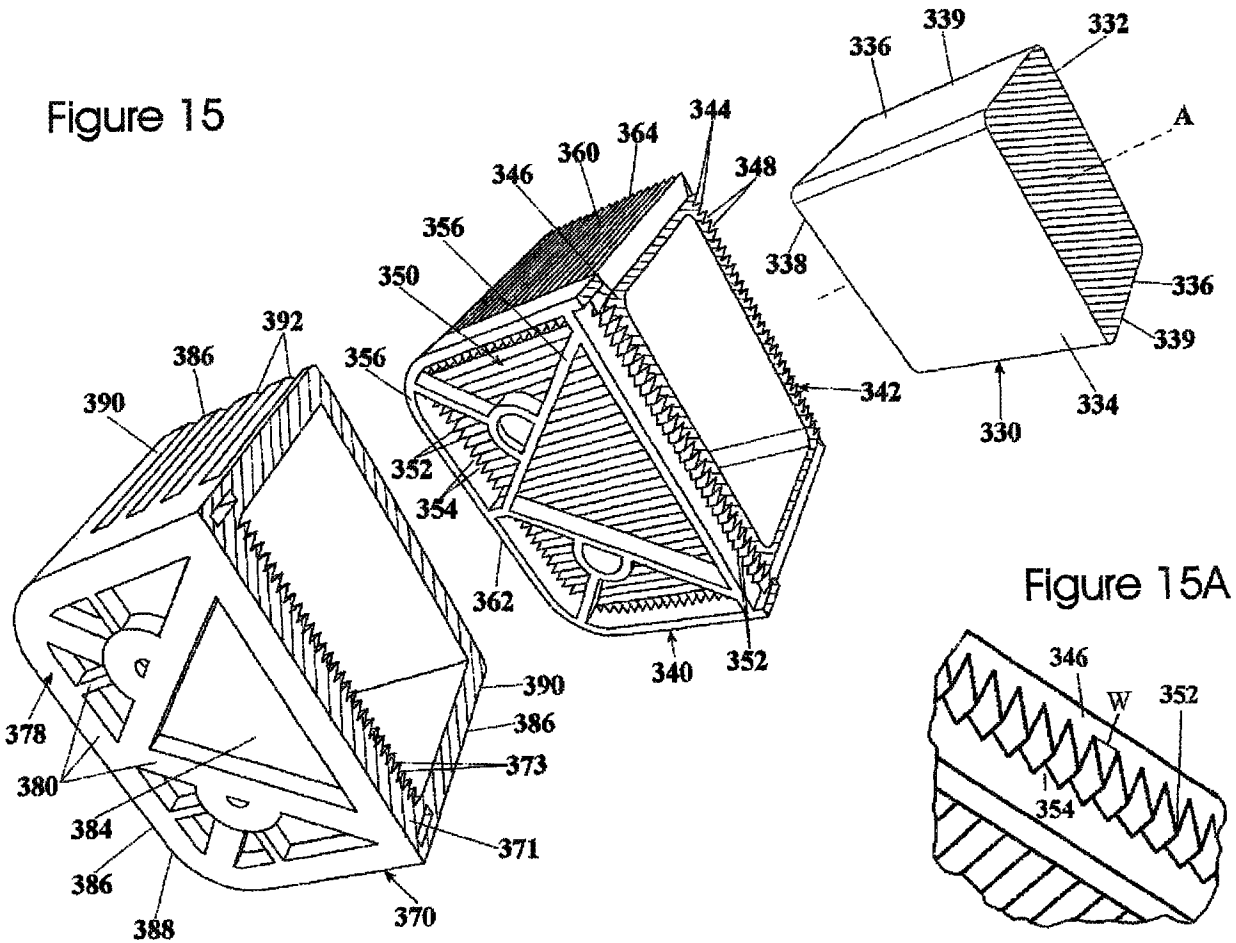
FIG. 15 illustrates a bottom exploded perspective view of the end portion of the inner and outer encapsulations and core of the embodiment of FIG. 12 with a simplified view of inner surfaces of the outer encapsulation.
FIG. 15A illustrates a closer view of the bottom of the inner encapsulation.

The core 330 of the present example embodiment may be constructed of materials consistent with that of the previously disclosed embodiment, such that it may include wood, wood-product, engineered wood product, and/or engineered plastic product. The core 330 has a top surface 332, a bottom surface 334, and side surfaces 336. The side surfaces 336 include spaced apart ends 338 that run perpendicular to the longitudinal axis A of the core, and spaced apart elongated sides 339 that run parallel to the longitudinal axis A of the core 330. FIGS. 12 and 13 show top and bottom perspective views of a first end portion of the tie 310, having an end 338, but it will be appreciated that the opposite or second end portion is a mirror image of the first end portion that is shown. FIG. 14 shows a perspective view of the outer surfaces of an end portion of the first and second sleeves 340 and 370, while FIG. 15 provides a somewhat simplified exploded perspective view from below an end portion of the railroad tie 310. In FIG. 15, a core 330 is shown in a simplified view, such as without depicting any surface irregularities that may be naturally occurring with a wood timber core, or that may be purposefully formed into a wood timber or fabricated core, such as to enhance adhesion of the inner sleeve to the core.

The inner or first sleeve 340 of the present embodiment may be constructed of materials consistent with that of the previously disclosed embodiment, such that it may include at least one of the group consisting of plastic, plastic-composite or non-plastic polymers. The outer surface of the first sleeve 340 of this embodiment, as best seen in FIGS. 14 and 15, includes a top surface 342 that includes top fingers 344 that protrude vertically from a solid base layer 346 and form gaps 348 therebetween, with the top fingers 344 and gaps 348 running horizontally and parallel to the longitudinal axis A of the core 330. The first sleeve 340 of the tie 310 includes a bottom surface 350 having bottom fingers 352 that protrude vertically from the solid base layer 346 and form gaps 354 therebetween, with the bottom fingers 352 and gaps 354 running horizontally and parallel to the longitudinal axis A of the core 330. This is better understood from the isolated, closer view of a portion of the bottom surface of the first sleeve 340 in FIG. 15A, where the base layer 346, a finger 352, a gap 354 between fingers, and the width W of a finger are illustrated. In this embodiment, the bottom surface 350 also includes protruding ridges 356 forming closed shapes, which will be used to support and reduce the required thickness of protruding ridges on the bottom of the second sleeve 370.

The first sleeve 340 provides the first encapsulation of the core 330 and is shown with a smooth inner surface 358. However, it will be understood that the injection molded first sleeve material will flow around the core 330 and match the particular contours on the outer surface of the core 330. The solid base layer 346 of the first sleeve 340 is in contact with the core 330, and the top and bottom fingers 344 and 352 run parallel to the longitudinal axis A of the core 330. The engaged first and second sleeves have their respective fingers intermesh and their taller dimension runs parallel to the longitudinal axis A of the core 330, thereby increasing the effective beam height of the tie 310. This orientation of the top and bottom fingers significantly enhances the bending stiffness of the tie 310 across the length of the finished product while still permitting rapid cooling of each of the respective sleeves, and permitting the top and bottom fingers to slide along their length, if necessary, as the tie 310 flexes under load.

The first sleeve 340 of the tie 310 also includes side surfaces 360. The side surfaces 360 include first side surfaces 362 that are located at spaced apart ends of the first sleeve 340 and run perpendicular to the longitudinal axis A of the core 330. The side surfaces 360 also include second side surfaces 364 that are located at spaced apart elongated sides of the first sleeve 340 and run in their longest dimension parallel to the longitudinal axis A of the core 330. The side surfaces 360 include side fingers 366 that protrude horizontally from the solid base layer 346 and form gaps 368 therebetween, with the side fingers 366 and gaps 368 running vertically and perpendicular to the longitudinal axis of A of the core 330. It will be appreciated that the first sleeve 340, with its various top and bottom fingers 344 and 352 running parallel to the longitudinal axis of A of the core 330, and the side fingers 366 running perpendicular thereto, have a unique intersection or transition where the respective fingers meet, as best seen in FIG. 14. Such one-step formation of the respective fingers and transitions from fingers on one surface to fingers on another surface can only be formed in an operation via injection or compression molding, and could not be formed via extrusion.

The outer or second sleeve 370 of the present embodiment may be constructed of materials consistent with that of the previously disclosed embodiment, such that it too may include at least one of the group consisting of plastic, plastic-composite or non-plastic polymers. Portions of the second sleeve 370 are shown in FIGS. 12-15, with the view in FIG. 15 being a somewhat simplified perspective view in that it is shown with smooth inner top and side surfaces. However, it will be appreciated that when the second sleeve 370 is injection molded over the first sleeve 340, the material of the second sleeve 370 will flow into the gaps between the top fingers 344, the bottom fingers 352 and the side fingers 366 of the first sleeve 340, to form corresponding top fingers, bottom fingers 373 and side fingers within the second sleeve 370 that extend from an outer solid layer 371 toward the core 330, just as is seen with respect to the material that flowed between the bottom fingers 352 of the first sleeve 340 to form the bottom fingers 373 of the second sleeve 370. Thus, it will be understood that in a completed version of this embodiment of tie 310, all of the inner walls of the second sleeve 370 actually would have corresponding fingers that intermesh with the fingers of the first sleeve 340.

The second sleeve 370 of the tie 310 includes a bottom surface 378 that includes protruding ridges 380 that form closed shapes. In this example embodiment, the bottom surface 378 has the protruding ridges 380 molded in tread patterns to capture and compress ballast, such as are shown with chevrons 382 and triangles 384 that are formed by the series of protruding ridges 380. Raised or protruding ridges 380 on the bottom surface of the tie 310 can be molded within the second sleeve 370 exclusively, and in varying widths, preferably with a slight draft angle, as discussed above with respect to a prior embodiment. However, the present embodiment includes a special enhancement in that the protruding ridges 380 forming closed shapes on the bottom surface of the second sleeve 370 may be made wider and stronger, while still achieving faster and more uniform cooling of the encapsulation layers. This can be accomplished by molding the relatively wide protruding ridges 380 on the bottom surface 378 of the second sleeve 370 directly over previously formed protruding ridges 356 on the bottom surface 350 of the first sleeve 340. For instance, the finished width of a protruding ridge 380 can be three times as wide as a protruding ridge 356, while actually having a material thickness that is the same as the width of the protruding ridge 356, because the thickness of the material of the protruding ridge 356 will be sandwiched between two thicknesses of the material of the protruding ridge 380.

The second sleeve 370 of the tie 310 also includes side surfaces 386. The side surfaces 386 include first side surfaces 388 that are located at spaced apart ends of the second sleeve 370 and run perpendicular to the longitudinal axis A of the core 330. The side surfaces 386 also include second side surfaces 390 that are located at spaced apart elongated sides of the second sleeve 370 and run in their longest dimension parallel to the longitudinal axis A of the core 330. The side surfaces 386 may include a pattern molded therein, such as spaced apart scallops or grooves 392 that run vertically and perpendicular to the longitudinal axis A of the core 330 and that may serve a functional purpose, such as permitting ballast to better grip the side surfaces 390 of the tie 310. This enhances the tie's resistance to longitudinal motion which is parallel to the longitudinal axis A, as well as the tie's manual gripping surfaces. At the juncture of the first side surfaces 388 and the second side surfaces 390 are rounded corners 394 which provide for easier installation of a tie 310 when it must be slid into place in a bed of ballast, as well as easier stacking of manufactured ties 310.

The fingers that are created when molding the first and second sleeves 340 and 370 of this embodiment have other important aspects. The first and second sleeves having a solid layer 346 and 371 from which the fingers protrude, with no portion of either sleeve being overly thick, provide significant advantages in process time due to more rapid and stable cooling. This also provides greater resistance to shrinkage. The ability to mold two separate, thinner encapsulating sleeves, not only speeds and stabilizes cooling but further permits different, discrete materials to be used for the two sleeves without mixing them into a single, composite material. Thus, a stronger material that may not be very resistant to UV radiation can be used for the inner or first sleeve 340, while a material that is more resistant to the elements encountered in the environment can be used for the outer or second sleeve 370.

The advantage of having two or more separate encapsulating sleeves is taken to an entirely new level by the ability to injection mold the sleeves and by the discovery that a railroad tie can be made with sleeves having corresponding top and bottom fingers having a longitudinal orientation that runs parallel to the longitudinal axis A of the core 330 and that together increase the beam height and bending stiffness over the elongated tie 310 while, if necessary, permitting the fingers of the two sleeves to slide relative to each other, yet still having the sleeves be locked together by further including side fingers that have an orientation that runs perpendicular to the longitudinal axis A of the core 330, and which increases the width and vertical load capacity of the tie 310. The resulting railroad tie also avoids the need to have special attachment hardware and arrangements, such as the use of predrilled through holes with nuts and bolts. Accordingly, the present railroad tie 310 can be used with cut spikes and standard rail mounting hardware, without requiring pre-drilling, special fasteners or unique fastener locations, as may be required with some prior art ties.

FIGS. 12 and 13 illustrate other advantages of the present embodiment where the outer surface of the second sleeve 370 of the railroad tie 310 is shown from below and from above the tie, respectively. One can see that the second sleeve 370 of the tie 310 includes a top surface 372 that may include product identification information 374 molded therein, as well as a pattern 376 molded therein. The pattern may be formed within the single molding step for the second sleeve and may be functional, such as to assist in channeling water off of the tie or cutting glare, or may be of a more decorative nature, or both, such as when including the wood grain pattern that is shown that is both decorative and serves as a glare diffuser.

This embodiment may be manufactured via injection molding by a method which includes the several steps. For instance, one would first obtain a core comprising wood, wood-product, engineered wood product, or engineered plastic product within a mold, with the core having a longitudinal axis extending parallel to its longest dimension. Next, one would melt a first sleeve material comprising plastic, plastic-composite, or non-plastic polymers and inject the first sleeve material into the mold containing the core so that the first sleeve material forms a first encapsulation of the core. The first encapsulation would include a solid layer with a plurality of top fingers protruding from the solid layer along a top surface and forming gaps between the plurality of top fingers that extend parallel to the longitudinal axis of the core, and with a plurality of side fingers protruding from the solid layer along side surfaces and forming gaps between the plurality of side fingers that extend perpendicular to the longitudinal axis of the core. Then, one would cool the first encapsulation and core. Next, one would melt a second sleeve material comprising plastic, plastic-composite, or non-plastic polymers and inject the second sleeve material into a mold containing the core that has been encapsulated in the first encapsulation. By such injection, the second sleeve material would flow between the fingers formed in the first encapsulation by the first sleeve material, thereby forming fingers in the second sleeve material that extend parallel to the longitudinal axis of the core along the top surface of the first sleeve and that extend perpendicular to the longitudinal axis of the core along the side surfaces of the first sleeve, so that the second sleeve material forms a second encapsulation that encapsulates the first encapsulation. Then, one would cool the second and first encapsulations and the core.

Figure 16:
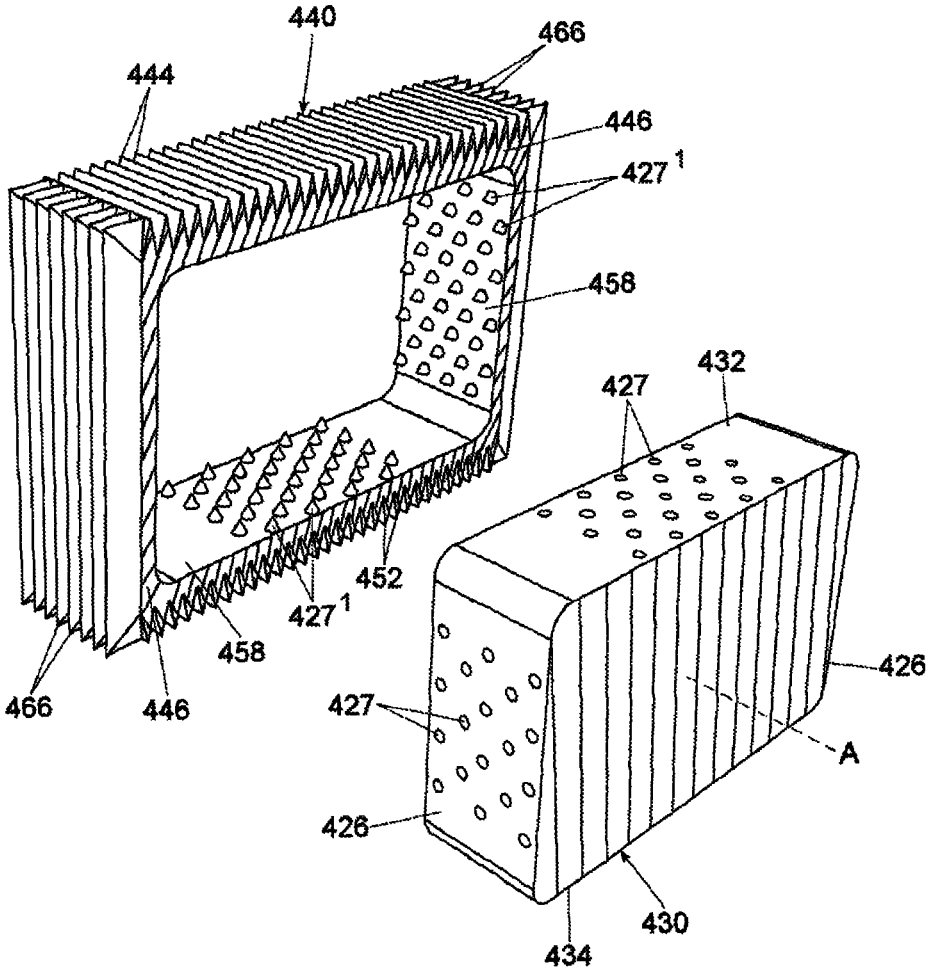
FIG. 16 illustrates a top exploded perspective view of a section of the inner encapsulation and core of a further embodiment.

A portion of an alternative, further advantageous embodiment of a railroad tie is illustrated in FIG. 16. A section of a core 430, which may be constructed of materials described above with respect to the core 330, illustrates a further advantageous treatment of the core 430. In particular, top and bottom surfaces 432 and 434, as well as side surfaces 426 of the core 430 include a pattern of impressions 427. The impressions 427 may be formed into the core 430 by pressing, drilling or any other suitable means. In turn, when the first sleeve 440 is molded over the core 430, the first sleeve material forms the solid base layer 446 having top fingers 444, bottom fingers 452, and side fingers 466 protruding therefrom, while having inner surfaces 458 that cover and correspond to the core 430. Thus, the material of the first sleeve 440 flows into and fills the impressions 427 in the core 430. This results in the first sleeve 440 of this alternative embodiment including protrusions 427$^1$ that fill and correspond to the impressions 427. This arrangement with first sleeve inner protrusions filling impressions in the core 430 can enhance adhesion and reduce the likelihood of displacement of the first sleeve 440 relative to the core 430.

To further enhance the strength and cooling properties, the first and/or second sleeves may include variations in the construction of the respective fingers to accommodate more complex tie configurations. Thus, there can be non-uniform fingers that vary relative to each other in the length, in width, and in shape, and the ratio of the length of the fingers to the thickness of the solid base layer may vary as well. Such variations may occur in particular more complicated portions of embodiments. An example of such variation is illustrated in a portion of another advantageous alternative railroad tie that is shown in a section view of a further example embodiment in FIG. 17, with a core 530, a first sleeve 540, and a second sleeve 570. In this alternative embodiment, a first side surface 562 of the first sleeve 540 may include protruding fingers 566 having a first width W1 at their junction with a solid base layer 546 and a second side surface 564 of the first sleeve 540 may include protruding fingers 566$^1$ having a second width W2 at their junction with the solid base layer 546. The widths W1 and W2 of the respective fingers 566 and 566$^1$ may be selected to accommodate the length of the respective side surfaces, as well as to enhance the strength and cooling properties of the respective first and second sleeves of the railroad tie. In this example, the second width W2 is greater than the first width W1.

Figure 17:
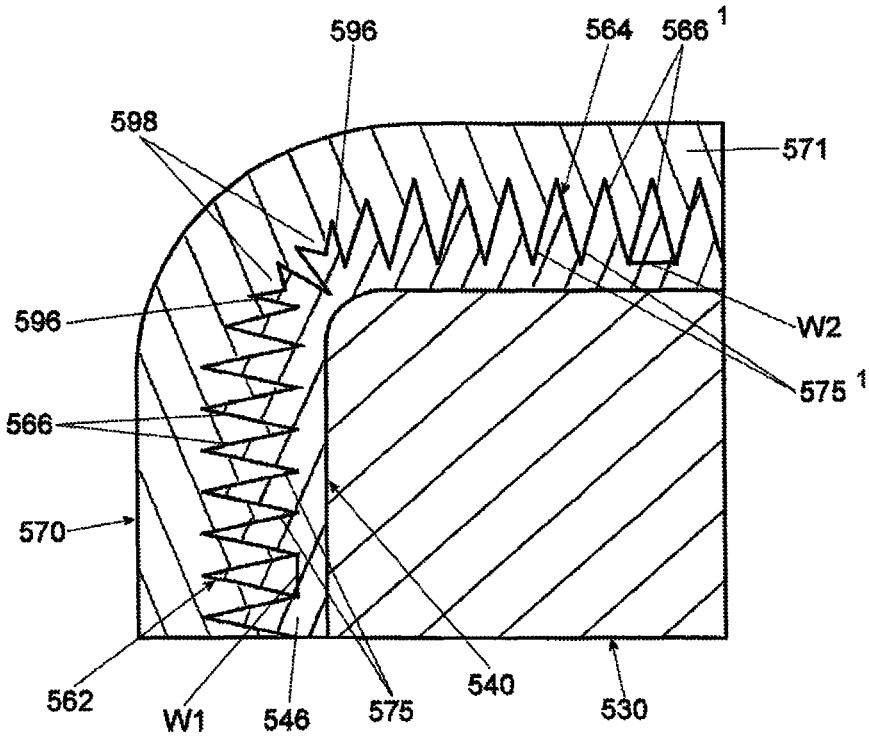
FIG. 17 illustrates a horizontal cross sectional view through a corner portion of the inner and outer encapsulations and core of a further embodiment.

Also illustrated in the example shown in FIG. 17, each of the fingers 566 and 566$^1$ is formed with a single peak that is directed away from the core 540. In a further advantageous feature, at the juncture of a first side surface 562 and a second side surface 564 of a first sleeve 540, the first sleeve 540 may include specially formed transition or corner fingers 596 in the first encapsulation. The corner fingers 596 of this further example embodiment include a plurality of peaks protruding therefrom, which are shown as two peaks directed away from the core 530 and having gaps 598 between the corner fingers that run perpendicular to the longitudinal axis of A of the core 530. The corner fingers 596 and one finger to either side thereof provide an effective transition while also altering the ratio of the length of the fingers to the thickness of the base layer. It will be understood that during the molding process, the material of the second sleeve 570 will flow over and conform to the configuration of the first sleeve 540 to form first side fingers 575 and second side fingers 575$^1$ protruding from an outer solid layer 571 and having respective gaps therebetween, while also establishing the selected outer configuration of the second sleeve 570. The corner fingers 596 of the first sleeve 540 are specially formed at the transition between the two side surfaces 566 and 566$^1$ to enhance the strength and ensure proper cooling of the respective first and second encapsulations 540 and 570 upon injection molding of the first sleeve material to form the first encapsulation.

Figure 18A:
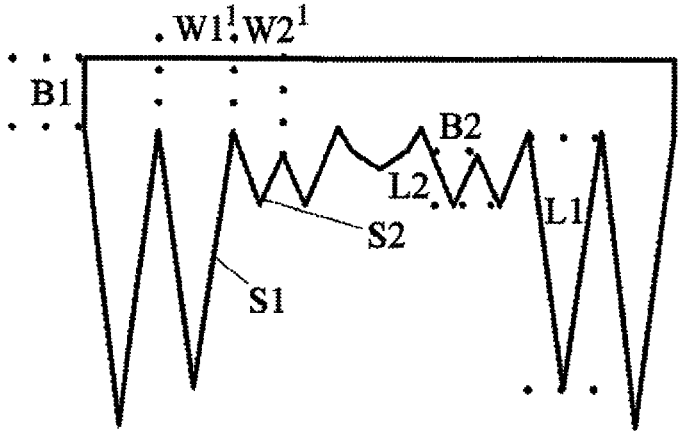
FIG. 18A illustrates respective dimensions associated with features of the inner encapsulation.
Figure 18:
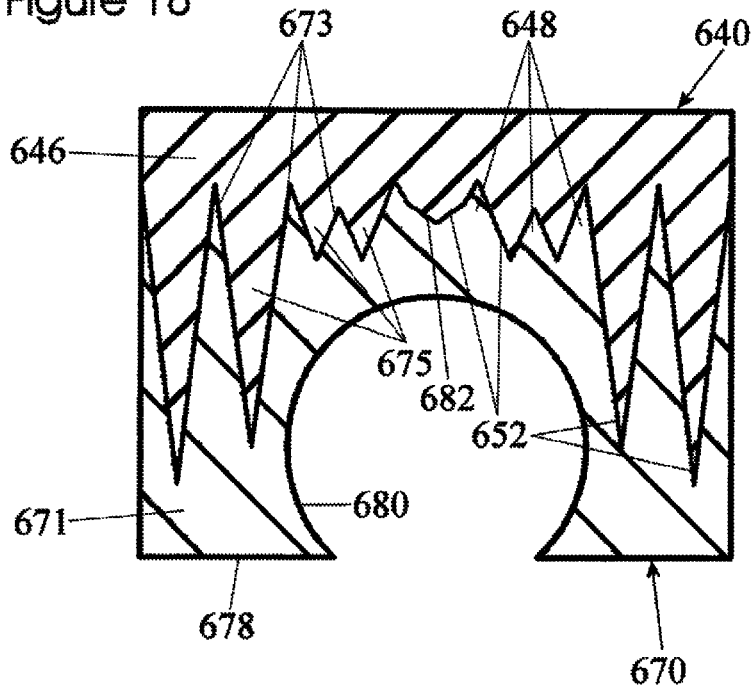
FIG. 18 illustrates a vertical cross sectional view of a lower portion of the inner and outer encapsulations of a further embodiment having channels in the bottom.

A portion of a further advantageous alternative railroad tie showing variations in finger constructions is shown in side section views in FIGS. 18 and 18A. FIG. 18 illustrates a portion of first and second sleeves that may be formed along a bottom of a core in a railroad tie that is to be used on a flat surface, such as in a tunnel. As with the embodiment shown in FIGS. 8 and 9, this embodiment includes a channel along its bottom surface. However, this embodiment includes an enhancement to provide for greater strength, as well as more uniform and faster cooling of the first and second sleeves. Accordingly, a first sleeve 640 is shown above a second sleeve 670. The second sleeve 670 has a bottom surface 678 that includes a channel 680 that runs perpendicular to a longitudinal axis of the core. The first sleeve 640 includes special bottom fingers 652 that protrude vertically from a solid base layer 646 and from gaps 648 therebetween that also run perpendicular to the longitudinal axis of the core, which is contrary to the orientation of the bottom fingers in the embodiment of FIGS. 12-15. This laterally directed orientation of the bottom fingers 652 of the first sleeve 640 permits a transition in which there are different solid base layer thicknesses B1 and B2 associated with the different fingers S1 and S2. The different fingers S1 and S2 also have different finger lengths, L1 and L2, widths W1[1] and W2[1], and shapes. It will be appreciated that toward the apex of the channel 680, the lengths of the fingers are reduced until they are shortest at the apex of the channel 680, and that a still further difference in shape is shown with respect to the finger 682 that has more than two planar surfaces and is positioned directly opposite the apex of the channel 680. Similarly, the ratio of the length of a finger to the thickness of the base layer varies with the change in the length of the fingers, as well as the change in the thickness of the solid base layer. These variations in the finger constructions occur in the transition that accommodates a lateral channel 680 in the bottom of the tie while improving the support for the second sleeve 670 and the speed and uniformity of cooling of the first and second sleeves.

It will be understood that during the molding process, the material of the second sleeve 670 will flow over and conform to the configuration of the first sleeve 640, while also establishing the selected outer configuration of the second sleeve 670 with the channel 680. Thus, in one step, there will be formed bottom fingers 673, of varying lengths, widths and shapes, that protrude from an outer solid layer 671 toward the core, with respective gaps 675 between the bottom fingers 673, so as to conform to the shape of the outer surface of the first sleeve 640.

While we have shown illustrative embodiments of the invention, it will be apparent to those skilled in the art that the invention may be embodied still otherwise without departing from the spirit and scope of the claimed invention. For instance, although the exemplary embodiments disclosed above have been generally limited to the traditional rectangular-shaped tie, non-rectangular embodiments also lie within the scope of the present invention.

The invention claimed is:

1. A railroad tie comprising:

a core comprising wood, wood-product, engineered wood product, or engineered plastic product;

a first sleeve encapsulating the core, wherein the first sleeve comprises at least one of the group consisting of plastic, plastic-composite, or non-plastic polymers;

a second sleeve encapsulating the first sleeve, wherein the second sleeve comprises at least one of the group consisting of plastic, plastic-composite, or non-plastic polymers;

the core having a longitudinal axis running parallel to its longest dimension;

wherein the first sleeve includes a top surface comprising top fingers protruding therefrom and having gaps between the top fingers that run parallel to the longitudinal axis of the core, and includes side surfaces with each side surface comprising side fingers protruding from the respective side surface and having gaps between the side fingers that run perpendicular to the longitudinal axis of the core;

wherein the second sleeve includes respective top fingers that fill the gaps between the top fingers of the first sleeve and that run parallel to the longitudinal axis of the core, and respective side fingers that fill the gaps between the side fingers of the first sleeve and that run perpendicular to the longitudinal axis of the core.

2. The railroad tie of claim 1, wherein the first sleeve further includes a bottom surface comprising bottom fingers protruding therefrom and having gaps between the bottom fingers that run parallel to the longitudinal axis of the core.

3. The railroad tie of claim 2, wherein the second sleeve further includes respective bottom fingers that fill the gaps between the bottom fingers of the first sleeve and that run parallel to the longitudinal axis of the core.

4. The railroad tie of claim 1, wherein the first sleeve further includes a bottom surface comprising bottom fingers protruding therefrom and having gaps between the bottom fingers that run perpendicular to the longitudinal axis of the core.

5. The railroad tie of claim 4, wherein the second sleeve further includes respective bottom fingers that fill the gaps between the bottom fingers of the first sleeve and that run perpendicular to the longitudinal axis of the core.

6. The railroad tie of claim 5, wherein the first sleeve includes bottom fingers of at least two different lengths.

7. The railroad tie of claim 6, wherein the second sleeve includes bottom fingers of at least two different lengths that fill the gaps between the bottom fingers of the first sleeve.

8. The railroad tie of claim 7, wherein the second sleeve further includes a bottom surface having channels that run perpendicular to the longitudinal axis of the core formed therein.

9. The railroad tie of claim 1, wherein the first sleeve further includes a bottom surface comprising protruding ridges forming closed shapes.

10. The railroad tie of claim 9, wherein the second sleeve further includes a bottom surface comprising protruding ridges forming closed shapes and being formed over the protruding ridges of the first sleeve.

11. The railroad tie of claim 1, wherein an exterior surface of the second sleeve further includes product identification information molded therein.

12. The railroad tie of claim 1, wherein an exterior surface of the second sleeve includes a pattern molded therein.

13. The railroad tie of claim 12, wherein the pattern in the second sleeve further comprises side surfaces having spaced apart grooves that run perpendicular to the longitudinal axis of the core.

14. The railroad tie of claim 1, wherein the second sleeve includes rounded corner surfaces.

15. The railroad tie of claim 1, wherein the side surfaces of the first sleeve include first side surfaces that are located at spaced apart ends of the first sleeve and that run perpendicular to the longitudinal axis of the core and second side surfaces that are located at spaced apart elongated sides of the first sleeve and that run parallel to the longitudinal axis of the core.

16. The railroad tie of claim 15, wherein the first side surfaces of the first sleeve include side fingers having a first width and the second side surfaces of the first sleeve include side fingers having a second width that is different than the first width.

17. The railroad tie of claim 1, wherein each top and side finger of the first sleeve comprises a single peak that is directed away from the core.

18. The railroad tie of claim 1, wherein the first sleeve further comprises corner fingers having a plurality of peaks protruding therefrom, being directed away from the core and having gaps between the corner fingers that run perpendicular to the longitudinal axis of the core.

19. The railroad tie of claim 1, wherein the core includes a pattern of impressions and the first sleeve further includes protrusions that fill the impressions in the core.

20. A method of manufacturing a railroad tie, comprising:

obtaining a core comprising wood, wood-product, engineered wood product, or engineered plastic product within a mold, the core having a longitudinal axis running parallel to its longest dimension;

melting a first sleeve material comprising plastic, plastic-composite, or non-plastic polymers and injecting the first sleeve material into the mold containing the core so that the first sleeve material forms a first encapsulation of the core, wherein the first encapsulation includes a solid layer with a plurality of top fingers protruding from the solid layer along a top surface and forming gaps between the plurality of top fingers that run parallel to the longitudinal axis of the core, and with a plurality of side fingers protruding from the solid layer along side surfaces and forming gaps between the plurality of side fingers that run perpendicular to the longitudinal axis of the core;

cooling the first encapsulation and core;

melting a second sleeve material comprising plastic, plastic-composite, or non-plastic polymers and injecting the second sleeve material into a mold containing the core that has been encapsulated in the first encapsulation, so that the second sleeve material flows between the fingers formed in the first encapsulation by the first sleeve material, thereby forming fingers in the second sleeve material that run parallel to the longitudinal axis of the core along the top surface of the first sleeve and that run perpendicular to the longitudinal axis of the core along the side surfaces of the first sleeve, so that the second sleeve material forms a second encapsulation that encapsulates the first encapsulation; and cooling the second and first encapsulations and the core.

* * * * *